United States Patent [19]

Mahmud

[11] Patent Number: 4,965,161

[45] Date of Patent: Oct. 23, 1990

[54] NON-CROSSLINKED ELECTROGRAPHIC COPOLYMER COMPOSITION AND IMAGING PROCESS

[75] Inventor: Nargis A. Mahmud, Nashua, N.H.

[73] Assignee: Nashua Corporation, Nashua, N.H.

[21] Appl. No.: 359,405

[22] Filed: May 31, 1989

[51] Int. Cl.[5] ..... G03G 9/087

[52] U.S. Cl. ..... 430/109; 430/110; 430/120

[58] Field of Search ..... 430/105, 107, 109, 137, 430/120

[56] References Cited

U.S. PATENT DOCUMENTS

| | | | |
|---|---|---|---|
| Re. 31,072 | 11/1982 | Jadwin et al. | 430/99 |
| 2,788,288 | 4/1957 | Rheintrank | 430/107 |
| 3,653,893 | 4/1972 | Jacknow et al. | 430/107 |
| 4,311,779 | 1/1982 | Miyakawa et al. | 430/107 |
| 4,426,433 | 1/1984 | Kohri et al. | 430/109 |
| 4,457,998 | 7/1984 | Gruber et al. | 430/98 |
| 4,486,524 | 12/1984 | Fujisaki et al. | 430/109 |
| 4,513,074 | 4/1985 | Nash et al. | 430/106.6 |
| 4,659,641 | 4/1987 | Mahalek et al. | 430/137 |
| 4,824,750 | 4/1989 | Mahalek et al. | 430/124 |

*Primary Examiner*—John L. Goodrow
*Attorney, Agent, or Firm*—Lahive & Cockfield

[57] ABSTRACT

Disclosed is a non-crosslinked copolymer composition, for use in developing an electrophotographic latent image, comprising a styrenic compound, methylmethacrylate, and a soft comonomer. The soft comonomer has the general formula:

wherein $R_1$ is a hydrogen or methyl group, and $R_2$ may be a ethyl, butyl, n-butyl, iso-butyl, ethyl-hexyl, propyl, octyl, lauryl or stearyl group. The softening range of this copolymer is 2 to 15 Celcius temperature units broader than comparable non-crosslinked copolymers which do not contain methyl methacrylate.

22 Claims, 1 Drawing Sheet

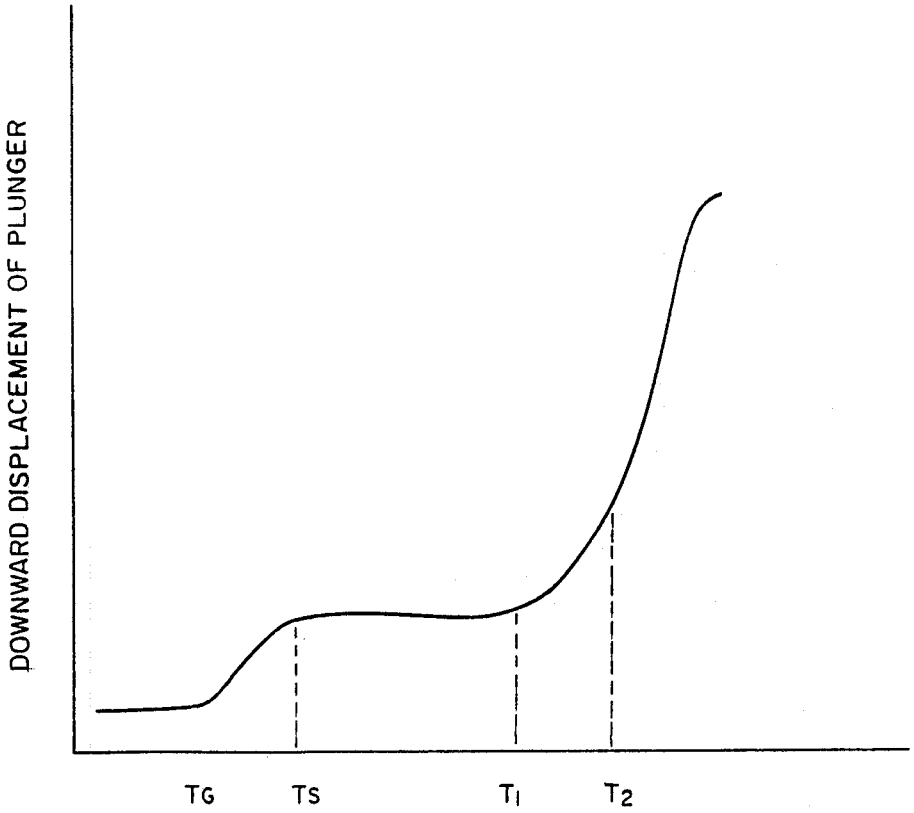
DOWNWARD DISPLACEMENT OF PLUNGER
TG
TS
T1
T2

NON-CROSSLINKED ELECTROGRAPHIC COPOLYMER COMPOSITION AND IMAGING PROCESS

BACKGROUND OF THE INVENTION

The present invention relates to electrographic copolymer compositions and electrographic imaging processes using such compositions.

Electrographic imaging and developing processes are well known in the art. These processes typically require forming a latent electrostatic charge image on an insulating electrographic element. The image is then made visible by treatment with an electrostatic toner composition or developer.

Developers generally comprise a polymeric toner material and carrier particles. The toner material may include a pigment such as carbon black or other colorant to darken or color images produced by the process. Carrier particles may be either a triboelectrically chargeable magnetic or non-magnetic material. Magnetic carrier particles include iron oxide, iron filings or powdered iron. Non-magnetic carrier particles may include glass beads or crystals of inorganic salts such as sodium or potassium chloride.

Typically, in an electrographic imaging process a developed image is formed on a photoconductive element and then transferred to a receiving sheet. The image is fixed by heating to fuse the transferred image. The toner material must therefore be capable of being fused under temperature conditions which will not result in charring, burning or other damage to the paper receiving sheet.

The transferred image is typically fixed by bringing the transfer sheet, bearing the transferred image, into contact with a heated fusing roller. During this process "toner offsetting" may result. Toner offsetting is the undesirable transfer of toner particles from the unfused toner image, carried on a receiving member (e.g., copy sheet), to the surface of a heated fusing member. The surface of the fusing member thus becomes contaminated with toner particles. The contaminating particles may be transferred to subsequent copy sheets upon further use of the fusing member. The typical contamination results in undesirable deposits of toner material on subsequent copy sheets in the form of a ghost image of previously fixed images, or in the image background of subsequent sheets. By extending a toner's softening range the range over which minimal toner offset occurs may be extended, eliminating or substantially decreasing the amount of overall toner offset.

The "softening range" as used herein is defined as the difference between (a) the temperature at which the plunger of a Schimadzu CFT 500 Flow Tester is displaced 4 millimeters, and (b) the temperature at the beginning of the rubbery plateau for a given sample. Softening ranges for typical non-crosslinked toner copolymers range from about 35 to about 45 Celsius temperature units. An extension of the softening range, by as little as two to three Celsius temperature units, produces significant differences in the copolymer's physical properties.

Many attempts have been made to extend the softening range or fusion range of toner copolymers. For example, U.S. Pat. No. RE. 31,072 proposes a solution to the problem of toner offsetting by providing a crosslinked toner with an extended fusion range. Although such a crosslinked toner may produce decreased toner offsetting, it would be advantageous to decrease toner offset with easily formulated, non-crosslinked toners having extended fusion, and hence, softening ranges.

Accordingly, it is an object of the invention to provide a toner for use with electrographic imaging processes which minimizes the potential occurrence of toner offsetting. Another object of the invention is to provide a method of reducing the offsetting problem in electrographic imaging processes. A further object is to provide a non-crosslinked polymeric toner material having an extended softening range for use with electrographic imaging processes. Other objects will be apparent to those of ordinary skill in the art upon reading the following disclosure.

SUMMARY OF THE INVENTION

The invention provides a non-crosslinked toner polymer. The toner polymer features a softening range which is broader than comparable typical non-crosslinked toner polymers by approximately 2 to 15 Celsius temperature units. The extended softening range of the polymer is advantageous as it greatly reduces, or altogether eliminates, the toner offset problem associated with electrographic copying processes.

The non-crosslinked toner polymer of the invention comprises a copolymer formed by the copolymerization of a styrenic monomer, methylmethacrylate, and one or more "soft" comonomers. The "soft" comonomers are defined as monomers, the homopolymers of which have glass transition temperatures between about −60° C. and about 20° C. and the general formula:

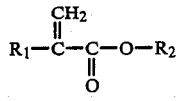

wherein $R_1$ is a hydrogen or methyl group, and $R_2$ may be alkyl having 2 to 18 carbon atoms, and preferably is ethyl, butyl, n-butyl, iso-butyl, ethyl-hexyl, propyl, octyl, lauryl and stearyl. Typically, the soft comonomer is an acrylate, however, methacrylate compounds may be used as well. Useful acrylates, include but are not limited to, ethyl-hexyl acrylate, n-butyl acrylate, ethyl acrylate, propyl acrylate, and isobutyl acrylate. Methacrylates which may be used as soft comonomers include, but are not limited to, n-butyl methacrylate, 2-ethyl-hexyl methacrylate, lauryl methacrylate and stearyl methacrylate.

The toner copolymer is preferably prepared by free radical polymerization of the constituent monomers using known initiators including peroxides, and azo compounds. The styrene monomer typically comprises about 45–80% of the monomer mixture, methylmethacrylate 5–45%, and the soft comonomer(s) from 0–35%.

DESCRIPTION OF THE DRAWING

The sole FIGURE is a typical melt flow profile of a non-crosslinked toner copolymer of the invention.

DETAILED DESCRIPTION OF THE INVENTION

The invention features non-crosslinked toner compositions having extended softening ranges The extended toner softening range eliminates or greatly reduces the toner offset problem often encountered in electrographic imaging processes The FIGURE illustrates a melt flow profile of a non-crosslinked toner copolymer of this invention, analyzed in a Schimadzu CFT 500 Flow Tester. Referring to FIG. 1, $T_s$ represents the temperature at which the rubbery plateau of the sample begins, and is a temperature close to the Fisher-Jones softening temperature. $T_1$ is the temperature at which the polymer begins to flow, i.e., the temperature at which the plunger of the Flow Tester is displaced 0.01 mm into the sample. The flow temperature ($T_2$) is that temperature at which the plunger is displaced 4 mm. The softening range of the polymer sample is the difference between $T_2$ and $T_s$.

The present non-crosslinked toners are prepared by copolymerizing a styrenic monomer, methylmethacrylate, and at least one soft monomer. Typical soft monomers include acrylates and methacrylates.

The styrenic monomer may account for between about 45 and about 80 percent by weight of the total monomer mixture. Although styrene is the preferred monomer, certain homologs of styrene such as vinyl toluene, α-methyl styrene, α-chloro styrene, and vinyl naphthalene may also be used. The methylmethacrylate monomer component, Preferably accounts for approximately 5–45 percent by weight of the total monomer mixture.

A wide variety of soft comonomers, i.e., monomers, the homopolymers of which have glass transition temperatures between about −60° C. and about 20° C., may be used in the invention. The soft comonomers useful in forming the toner composition of this invention have the general structural formula:

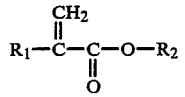

wherein $R_1$ may be hydrogen or a methyl group, and $R_2$ may be an alkyl having 2 to 18 carbon atoms. Useful soft comonomers include ethyl acrylate, 2-ethoxy ethyl acrylate, ethyl butyl acrylate, propyl acrylate, 3-ethoxy propyl acrylate, butyl acrylate, isobutyl acrylate, hexyl acrylate, 2-ethyl hexyl acrylate, heptyl acrylate, isoheptyl acrylate, octyl acrylate, isooctyl acrylate, nonyl acrylate, octadecyl acrylate, butyl methacrylate, dimethyl amino ethyl methacrylate, hexadecylmethacrylate, hexyl methacrylate, 2-ethyl hexyl methacrylate, decyl methacrylate, dodecyl methacrylate, octadecyl methacrylate and stearyl methacrylate. The most preferred soft comonomers include ethyl hexyl acrylate, n-butyl acrylate, isobutylacrylate, ethyl hexyl methacrylate, n-butyl methacrylate, lauryl methacrylate and stearyl methacrylate. The soft monomer may comprise up to 35 percent by weight of the total monomer mixture.

The monomer mixture is polymerized through a copolymerization reaction with the aid of a suspending agent and an initiator. The choice of a suitable suspending agent is well within the skill of one having ordinary skill in the art. M. Munzer and E. Trommsdorf, POLYMERIZATION PROCESSES (Edited by C. Schildnecht and I. Skeist, Published by Wiley Interscience, 1977), incorporated herein by reference, discloses a variety of suspending agents, both water-soluble and water-insoluble, which may be used in this copolymerization reaction. Examples of useful water soluble suspending agents include methyl cellulose; hydroxyethyl cellulose; carboxymethylcellulose; polyacrylic acid and salts thereof; and polymethacrylate and its copolymers. The preferred water-soluble suspending agents are the partially saponified polyvinyl esters such as polyvinyl alcohols. The water-insoluble suspending agents are typically used in conjunction with a surfactant. The surfactant controls the wetting angle and thus the dispersing action of the agent. Useful water-insoluble suspending agents and, where applicable, the surfactants include calcium carbonate with a fatty acid surfactant; magnesium carbonate with a polyvinyl alcohol surfactant; zinc oxide; calcium oxalate with emulsifiers; and, most preferably, calcium phosphate with various emulsifiers.

A number of known free radical initiators may be used to initiate the copolymerization of the monomer mixture. Typical initiators include benzoyl peroxide; lauroyl peroxide; acetyl peroxide; decanoyl peroxide t-butyl perbenzoate; t-butyl(ethyl-hexyl)monoperoxycarbonate; 2,2 azobis (2,4-dimethyl valeronitrile); 2,2 azobis (2,4-dimethyl 1,4-methoxy valeronitrile); and 2,2 azobisisobutyronitrile. Benzoyl peroxide and 2,2 azobisisobutyronitrile are among the most preferred initiators.

To prepare the toner copolymer of the invention, the monomer mixture (i.e., a styrenic monomer, methylmethacrylate, and at least one soft comonomer) is suspended in an aqueous solution in the presence of an initiator and suspending agent. As is well known to those having ordinary skill in the art, the glass transition temperature of the resultant copolymer may be controlled by manipulation of its monomer composition. The glass transition temperature, $T_g$, of a random copolymer having two or more monomers is determined by the glass transition temperatures of the homopolymers of the comonomers ($T_{g1}$, $T_{g2}$, . . . $T_{gn}$) and their respective weight percents ($W_1$, $W_2$, . . . $W_n$) as expressed in the formula:

$$\frac{1}{T_g} = \frac{W_1}{T_{g1}} + \frac{W_2}{T_{g2}} + \ldots + \frac{W_n}{T_{gn}}$$

In the invention, the styrenic homopolymer preferably has a glass transition temperature of about 90° C. to 170° C., and homopolymers of the soft comonomer preferably between about −60° C. and 20° C. Methyl methacrylate homopolymer has a $T_g$ of 103° C. For example, by substituting additional methyl methacrylate for the styrene comonomer, while maintaining the weight percent of the soft comonomers constant, copolymers with comparable glass transition temperatures may be produced. Although the glass transition temperatures of these polymers are close to each other, comparatively higher melt viscosities of methylmethacrylate substituted copolymers, produces a higher flow temperature ($T_2$) extending the softening range of the copolymer. The softening range of the copolymer may be as great as 50 to 100 Celsius temperature units.

The copolymer typically has a molecular weight between 70,000 and 200,000 daltons depending upon the reaction conditions. A molecular weight between 90,000 and 175,000 daltons is preferred.

Various processing aids and lubricants may be added after formation of the toner copolymer, and before use in electrographic imaging processes. These materials, known to those skilled in the art, include zinc stearate, silicone carbide, and polypropylene. In addition, various suitable colorants and/or pigment particles may be selected for the toner and developer compositions prepared according to the invention. Such materials include carbon black, Nigrosine dye, and mixtures thereof.

Suitable carrier materials that can be employed in formulating the developer composition of the invention (toner and carrier particles) include those materials, known to those having ordinary skill in the art, capable of triboelectrically obtaining a charge of opposite polarity to that of the toner particles. Typical carriers include steel, nickel, iron oxides, ferrites, silicon dioxide, and the like. The amount of carrier particles employed may be determined empirically.

Charge control agents, familiar to those skilled in the art, may also be added to the toner composition. These agents impart the desired positive or negative triboelectric charge to the toner. Typical charge control agents include alkyl pyridinium compounds, oil black of nigrosine, and the like.

The invention will be more apparent from the following illustrative, non-limiting examples. Parts and percentages are by weight unless otherwise indicated.

EXAMPLE 1

A one-liter separable flask was charged with 0.25 parts of a partially saponified polyvinyl alcohol available under the trademark Vinol 540 from Air Products, Inc. of Allentown, Pa. The polyvinyl alcohol was then dissolved in two hundred parts of distilled water. One of the monomer mixtures given in Table 1 below, and 0.6 parts of benzoyl peroxide, were then added to the flask under agitation.

TABLE 1

| POLYMER SAMPLE | COMPOSITION | | |
|---|---|---|---|
| | Styrene | Methyl methacrylate | 2-Ethyl-hexyl Acrylate |
| 1 | 80 | 0 | 20 |
| 2 | 75 | 5 | 20 |
| 3 | 70 | 10 | 20 |
| 4 | 65 | 15 | 20 |
| 5 | 60 | 20 | 20 |
| 6 | 55 | 25 | 20 |
| 7 | 50 | 30 | 20 |
| | Styrene | Methyl methacrylate | n-Butyl Acrylate |
| 8 | 80 | 0 | 20 |
| 9 | 70 | 10 | 20 |
| 10 | 60 | 20 | 20 |
| 11 | 50 | 30 | 20 |

The flask was then purged with nitrogen and the temperature elevated to 90° C. Polymerization was allowed to proceed for about five hours.

Following polymerization the reaction mixture was cooled to 50° C., filtered, washed repeatedly with water, and dried. The procedure resulted in a non-cross-linked copolymer.

EXAMPLE 2

The softening ranges of the toner copolymers produced in Example 1 were determined using a Schimadzu CFT 500 Flow Tester, manufactured by Shimadzu Scientific Instruments of Columbia, Md.

The softening characteristics of the toner copolymer were determined by extruding a sample of the toner copolymer through a nozzle. To perform softening range evaluations, a copolymer sample was placed into the cavity at the center of a heating block flow tester, with a plunger resting on its surface. The sample was preheated for 10 minutes at a temperature well below its predicted glass transition temperature. After 10 minutes, the temperature was steadily increased as the plunger applied a 10 kg/cm force to the surface of the sample. The downward displacement of the plunger was recorded against temperature to obtain a copolymer melt flow profile. In this experiment, the flow tester was equipped with an outlet nozzle having a 1 millimeter diameter and a length of 1 centimeter. Temperature was increased at 5° C./minute.

Table 2 shown below illustrates the results of this testing. These results illustrate the extended softening range possessed by the preferred copolymer formulations.

TABLE 2

| POLYMER SAMPLE | FLOW TEMPERATURES (°C.) | | | |
|---|---|---|---|---|
| | $T_s$ | $T_1$ | $T_2$ | $T_2-T_s$ (softening range) |
| 1 | 77 | 107 | 128 | 51 |
| 2 | 78 | 108 | 130 | 52 |
| 3 | 80 | 110 | 133 | 53 |
| 4 | 80 | 118 | 137 | 57 |
| 5 | 81 | 114 | 139 | 58 |
| 6 | 81 | 117 | 144 | 63 |
| 7 | 81 | 117 | 146 | 65 |
| 8 | 82 | 107 | 129 | 47 |
| 9 | 83 | 108 | 134 | 51 |
| 10 | 83 | 115 | 141 | 58 |
| 11 | 84 | 121 | 149 | 65 |

EXAMPLE 3

Polymer compositions 1 through 11 were tested to determine which compositions have viscosities in the preferred range of between $10^5$ and $10^6$ CPS at temperatures representative of those encountered during electrographic imaging processes. Toner hot offset appears to occur at viscosities below $2\times10^4$ CPS. The results of these tests are presented in Table 3.

TABLE 3

| POLYMER SAMPLE | VISCOSITY (CPS) | | | | | | | |
|---|---|---|---|---|---|---|---|---|
| | 115° C. | 136° C. | 139° C. | 142° C. | 145° C. | 148° C. | 151° C. | 154° C. |
| 1 | $2.8\times10^5$ | $3.8\times10^4$ | $<3\times10^4$ | — | — | — | — | — |
| 2 | $4.8\times10^5$ | $4.9\times10^4$ | $3.8\times10^4$ | $<3.0\times10^4$ | — | — | — | — |
| 3 | $5.3\times10^5$ | $5.5\times10^4$ | $4.0\times10^4$ | $3.0\times10^4$ | — | — | — | — |
| 4 | $9.0\times10^5$ | $7.5\times10^4$ | $5.7\times10^4$ | $4.1\times10^4$ | $3.0\times10^4$ | — | — | — |
| 5 | $9.6\times10^5$ | $8.6\times10^4$ | $6.9\times10^4$ | $5.3\times10^4$ | $4.0\times10^4$ | $3.9\times10^4$ | — | — |
| 6 | $4.8\times10^6$ | $1.45\times10^5$ | $1.1\times10^5$ | $8.0\times10^4$ | $6.7\times10^4$ | $5.3\times10^4$ | $3.9\times10^4$ | — |
| 7 | $>4.8\times10^6$ | $1.65\times10^6$ | $1.4\times10^5$ | $1.0\times10^5$ | $7.9\times10^4$ | $6.2\times10^4$ | $4.5\times10^4$ | $3.4\times10^4$ |
| 8 | $3.0\times10^5$ | $4.2\times10^4$ | $3.4\times10^4$ | — | — | — | — | — |
| 9 | $4.8\times10^5$ | $6.0\times10^4$ | $4.8\times10^4$ | $3.6\times10^4$ | $3.2\times10^4$ | — | — | — |
| 10 | $1.2\times10^6$ | $1.1\times10^5$ | $9.4\times10^4$ | $6.8\times10^4$ | $5.5\times10^4$ | $4.1\times10^4$ | $2.0\times10^4$ | — |
| 11 | $4.8\times10^6$ | $2.5\times10^5$ | $1.4\times10^5$ | $1.6\times10^5$ | $1.1\times10^5$ | $8.7\times10^4$ | $6.7\times10^4$ | — |

Formulations 4 through 7, and 9 through 11, produced the most favorable results, and maintained substantial viscosity at high temperatures

EXAMPLE 4

Copolymer sample 6 was prepared in accordance with the procedure of EXAMPLE 1. A toner including 46 parts copolymer sample 6, 47 parts magnetic iron oxide, 4 parts nigrosine dye, and 3 parts low molecular weight polypropylene was then prepared. Once mixed, the toner composition was Processed in a twin screw extruder, ground in an impact mill, and classified. Following classification, 2.5 parts silicon carbide and 0.2 parts zinc stearate were added.

The toner composition was then tested in a copier compatible with a monocomponent toner. After 80,000 copies neither a deterioration in copy quality nor toner buildup on the fusing member was observed.

EXAMPLE 5

Copolymer sample 6 was prepared in accordance with the procedure of EXAMPLE 1. Using 47 parts copolymer sample 6, 47 parts magnetic iron oxide, 3 parts nigrosine dye, and 3 parts polypropylene a toner composition was prepared. Once mixed, the toner composition was processed in a twin screw extruder, ground in an impact mill, and classified. Following classification, 2.5 parts silicon carbide and 0.3 parts zinc stearate were added.

The toner was then tested as in EXAMPLE 4. Throughout the test copy quality remained good and no toner buildup was observed on the fusing member.

EXAMPLE 6

A toner including 47 parts of copolymer sample 5, prepared in accordance with the procedure of EXAMPLE 1, 47 parts magnetic iron oxide, 3 parts nigrosine dye, and 3 parts polypropylene was prepared. Once mixed, the toner composition was processed in a twin screw extruder, ground in an impact mill, and classified.

The toner was tested in accordance with the procedure of EXAMPLE 4. Throughout the test no toner buildup was observed on the fusing member.

EXAMPLE 7

A toner comprised of 85 parts of copolymer sample 6, prepared in accordance with the procedure of EXAMPLE 1, 10 parts of Raven 5750 carbon black, and 5 parts of low molecular weight polypropylene was prepared. The toner was processed in a twin screw extruder, ground in an impact mill, and classified. Next, a developer composition was prepared by mixing the toner with carrier particles consisting of ferrite powder coated with a terpolymer of styrene-methylmethacrylate-vinyl pyrolidone. The developer composition was then employed to develop images in a copier having a dry fusing system. Throughout a test run of 80,000 copies, copy quality remained good and no toner build up was observed on the fusing member.

EXAMPLE 8

In accordance with the procedure of Example 1, a copolymer was prepared having 55 parts styrene, 22.5 parts methylmethacrylate and 22.5 part 2-ethyl-hexyl acrylate. Using 83 parts of the copolymer, 10 parts carbon black, 7 parts polypropylene and 1% silica (Aerosil 972 is available from Degussa, Inc., Teterboro, N.J.) a toner was prepared. The toner was processed in a twin screw extruder, ground in an impact mill and then classified . Using the toner, a developer was prepared and tested following the procedure of Example 7. Throughout the test, copy quality remained good and no toner buildup was observed.

EXAMPLE 9

In accordance with the procedure of Example 1, a copolymer was prepared having 50 parts styrene, 22.5 parts methyl methacrylate and 27.5 parts soft comonomers including 2-ethyl hexyl aCrylate and 2-ethyl hexyl methacrylate.

A toner was formulated by melt blending 85 parts of this copolymer, 12 parts of carbon black and 3 parts of quaternary ammonium charge control agent followed by grinding and classification.

The developer was prepared using the toner and atomized steel carrier coated with kynar. The developer composition was then employed to develop images in a high speed copier/duplicator. Copy quality was good and no hot offset was observed throughout the duration of test, i.e. 500,000 copies.

What is claimed is:

1. A toner composition for use with an electrographic copying process comprising a mixture of:

(a) a non-crosslinked copolymer prepared from a styrenic monomer, methylmethacrylate, and at least one additional, soft comonomer of the formula:

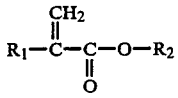

wherein $R_1$ is a hydrogen or methyl group, and $R_2$ comprises an alkyl group having 2–18 carbon atoms;

(b) a colorant; and (c) a charge control agent, said toner composition having a softening range of between about 50 and about 100 Celsius temperature units between about 60° C. and 170° C.

2. The composition of claim 1 wherein $R_2$ is selected from the group consisting of ethyl, butyl, n-butyl, isobutyl, ethyl-hexyl, propyl, octyl, lauryl and stearyl.

3. The composition of claim 1 wherein said soft comonomer comprises an acrylate.

4. The composition of claim 1 wherein said soft comonomer comprises a methacrylate.

5. The composition of claim 1 wherein the copolymer is formed from the following monomers in the following ratios:

(a) approximately 45–80% by weight of styrenic monomer;

(b) approximately 5–45% by weight of methylmethacrylate; and (c) up to 35% by weight of at least one soft comonomer selected from the group consisting essentially of n-butyl acrylate, ethyl hexyl acrylate, propyl acrylate and isobutyl acrylate, n-butyl methacrylate, 2-ethyl hexyl methacrylate, lauryl methacrylate and stearyl methacrylate.

6. The composition of claim 1 wherein the copolymer is formed from the following monomers in the following approximate ratios:

(a) 45–55% by weight of styrene;

(b) 10–25% by weight of methylmethacrylate;
(c) 15–25% by weight of ethyl-hexyl methacrylate; and
(d) up to 10% by weight of ethyl-hexyl acrylate.

7. The composition of claim 1 wherein the copolymer is formed from the following monomers in the following approximate ratios:
(a) 50–70% by weight styrene;
(b) 10–30% by weight methylmethacrylate; and
(c) 20–30% by weight n-butyl acrylate.

8. The composition of claim 1 wherein the polymer is formed from the following monomers in following approximate ratios:
(a) 50–70% by weight of styrene;
(b) 10–30% by weight of methylmethacrylate;
(c) 15–25% by weight of ethyl-hexyl acrylate.

9. The composition of claim 1 wherein the copolymer has a molecular weight ranging from 70,000 to 200,000 daltons.

10. The composition of claim 1 wherein the copolymer has a melt viscosity of between about $10^5$ and 104 CPS at between about 115° to about 165° C.

11. The composition of claim 1 wherein a homopolymer of the soft comonomer has a glass transition temperature of approximately −60° C. to 20° C.

12. An electrographic imaging process comprising the steps of:
providing toner particles comprising a mixture having a softening range of between about 50 and 100 Celsius temperature units between about 60° C. and 170° C., said mixture comprising:
(a) a non-crosslinked copolymer prepared from a styrenic monomer, methylmethacrylate, and at least one additional, soft comonomer of the formula:

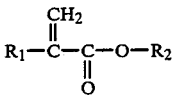

wherein $R_1$ is a hydrogen or methyl group, and $R_2$ comprises an alkyl group having 2–18 carbon atoms;
(b) a colorant; and
(c) a charge control agent;
contacting said toner particles with a member having an electrostatic image thereon; and
fixing said toner particles, in a pattern corresponding to said electrostatic image, to a receiving member by fusing said particles to said receiving member.

13. The method of claim 12 wherein $R_2$ is
from the group consisting of ethyl, butyl, n-butyl, iso-butyl, ethyl-hexyl, propyl, octyl, lauryl and stearyl.

14. The method of claim 12 wherein said soft comonomer comprises an acrylate.

15. The method of claim 12 wherein said soft comonomer comprises a methacrylate.

16. The method of claim 12 further comprising forming said non-crosslinked copolymer from the following monomers in the following ratios:
(a) approximately 45–80% by weight of styrenic monomer;
(b) approximately 5–45% by weight of methylmethacrylate; and
(c) up to 35% by weight of at least one soft comonomer selected from the group consisting essentially of n-butyl acrylate, ethyl-hexyl acrylate, propyl acrylate, isobutyl acrylate, n-butyl methacrylate, 2-ethyl-hexyl-methacrylate, lauryl methacrylate and stearyl methacrylate.

17. A developer composition for use with an electrographic copying process comprising a mixture of:
(a) a toner having a softening range of between about 50 and about 100 Celsius temperature units between about 60° C. and 170° C., said toner comprising a non-crosslinked copolymer prepared from a styrenic monomer, methylmethacrylate, and at least one additional, soft comonomer of the formula:

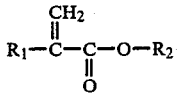

wherein $R_1$ is a hydrogen or methyl group, and $R_2$ comprises an alkyl group having 2–18 carbon atoms, a colorant, and a charge control agent; and
(b) carrier particles.

18. The composition of claim 17 wherein $R_2$ is selected from the group consisting of ethyl, butyl, n-butyl, iso-butyl, ethyl-hexyl, propyl, octyl, lauryl and stearyl.

19. The composition of claim 17 wherein the soft comonomer comprises an acrylate.

20. The composition of claim 18 wherein the soft comonomer is a methacrylate.

21. The composition of claim 17 wherein the copolymer is formed from the following monomers in the following approximate ratios:
(a) 45–80% by weight of styrenic monomer;
(b) 5–45% by weight of methylmethacrylate; and
(c) up to 35% by weight of at least one soft comonomer selected from the group consisting essentially of n-butyl acrylate, ethyl hexyl acrylate, propyl acrylate, isobutyl acrylate, n-butyl methacrylate, 2-ethyl hexyl methacrylate, lauryl methacrylate and stearyl methacrylate.

22. The composition of claim 17 wherein said carrier particle has a polymeric affixed thereto.

* * * * *